US006048436A

United States Patent [19]

Haupt et al.

[11] Patent Number: 6,048,436

[45] **Date of Patent: *Apr. 11, 2000**

[54] CONTINUOUSLY OPERATING DOUBLE-BELT PRESS

[75] Inventors: Ulrich Haupt, Wennigsen; Peter Hoffmann, Springe, both of Germany

[73] Assignee: Kvaerner Panel Systems GbmH Maschinen-und Anlagenbau, Springe, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/019,885

[22] Filed: Feb. 6, 1998

[30] Foreign Application Priority Data

Feb. 7, 1997 [DE] Germany ..... 197 04 681
Jul. 14, 1997 [DE] Germany ..... 197 30 152

[51] Int. Cl.[7] ..... B30B 5/06

[52] U.S. Cl. ..... 156/583.5; 100/311; 100/321; 100/154; 425/371

[58] Field of Search ..... 156/555, 580, 156/582, 583.1, 583.5; 425/371; 100/311, 321, 154

[56] References Cited

U.S. PATENT DOCUMENTS

| | | | |
|---|---|---|---|
| 4,565,509 | 1/1986 | De Mets | 425/101 |
| 5,229,139 | 7/1993 | Haupt | 425/107 |
| 5,272,967 | 12/1993 | Held | 100/93 P |
| 5,352,321 | 10/1994 | Held | 156/498 |
| 5,460,764 | 10/1995 | Held | 264/123 |
| 5,592,874 | 1/1997 | Blauhut | 100/93 RP |

FOREIGN PATENT DOCUMENTS

| | | |
|---|---|---|
| 0 052 359 A2 | 5/1982 | European Pat. Off. . |
| 0 128 968 A1 | 12/1984 | European Pat. Off. . |
| 0128968A1 | 12/1984 | European Pat. Off. . |
| 0 491 972 A1 | 7/1992 | European Pat. Off. . |
| 0491972A1 | 7/1992 | European Pat. Off. . |
| 0 550 782 B1 | 7/1993 | European Pat. Off. . |
| 0 679 502 A1 | 11/1995 | European Pat. Off. . |
| 0 642 917 B1 | 9/1998 | European Pat. Off. . |
| 37 04 940 A1 | 8/1908 | Germany . |
| 3921364A1 | 1/1991 | Germany . |
| 4041850A1 | 6/1992 | Germany . |
| 4208263A1 | 9/1993 | Germany . |
| 4414957C2 | 4/1996 | Germany . |
| WO 88/06082 | 2/1988 | WIPO . |
| WO 90/06841 | 6/1990 | WIPO . |

OTHER PUBLICATIONS

WPINDEX Copyright 1993 Derwent Information Ltd, & DE 4414957C2, English abstract.

WPINDEX Copyright 1993 Derwent Information Ltd, & DE 4208263A1, English Abstract.

*Primary Examiner*—James Sells
*Attorney, Agent, or Firm*—Townsend and Townsend and Crew LLP

[57] ABSTRACT

A continuously operating press is described for the manufacture and/or coating of board webs consisting of a fleece or mat in which the press belts are supported on a lubricant film formed on a slide lining. For the marginal width adjustment of the press zone the slide linings are subdivided into a main zone and adjoining marginal strip zones respectively. In one embodiment of the invention transition zones are in each case provided between two of these slide lining zones and are either made groove-free or provided with blind grooves, which serve neither as supply nor as discharge for lubricant. In a further embodiment of the invention adjacent grooves in these slide lining zones are alternatively provided with supply and discharge openings for the lubricant.

23 Claims, 4 Drawing Sheets

CONTINUOUSLY OPERATING DOUBLE-BELT PRESS

FIELD OF THE INVENTION

The invention relates to a continuously operating double-belt press, in particular for the manufacture and/or coating of a one-ply or multiple-ply web of particulate starting material, which runs in the transport direction between the upper run of a lower, endless press belt and the lower run of an upper, endless press belt circulating with predetermined speed, wherein a respective slide lining having grooves, which extends over the full width of the press zone and optionally sideways beyond it, is mounted on each of an upper and a lower support and is put together from individual sections, wherein the press belt associated with each slide lining slides over it by means of a liquid lubricant which is supplied under pressure, which is optionally heated or cooled, which is supplied via supply lines and through supply openings to form a sliding layer, and which is led off through discharge openings and through discharge lines connected thereto and is supplied to the press again in a circuit, optionally after being reheated or cooled.

DESCRIPTION OF PRIOR ART

The basic principle of a continuously operating press of this kind is known from EP 0 128 968 A1.

In one continuously operating press of this kind, as known from EP 0 491 972, measures are taken outside of the press zone in order to cause swirling of the lubricant escaping sideways in grooves formed in the slide lining, to reduce the pressure and to lead off the lubricant.

A plant for the manufacture of wooden chipboards and similar board materials is known from EP 0 344 192 B1 in which measures are provided in order to be able to manufacture boards of different widths and, in doing so, to avoid problems arising with small widths of the scattered mat, because the margins of the forming belts which project outwardly beyond the edge of the scattered mat no longer experience any counter-pressure and are no longer adequately pressed against their support surfaces or support. As a result of this lack of counter-pressure, the heat transfer to the forming band is also reduced and an extremely disturbing lowering of the temperature of the forming belts can result towards the edge. This can lead to critical thermal strains, in particular in the region of the deflection drums, because there the thermal strains are superimposed on the considerable longitudinal tension of the forming belts and the tensions which arise during their deflection through the extension of the outermost fibers, so that non-permissible total tensile strains can arise at the outer side of the regions of the forming belts directed over the deflection drums.

An attempt is made in accordance with EP 0 344 192 B1 to solve this problem in that an edge scattering of binder-free particles is scattered onto the lower forming belt in the free marginal zones between the board to be pressed and the outer edges of the total press zone and is co-pressed.

This procedure is extremely complicated and makes an extensive return of bulk scattered material necessary which considerably impairs the economy of a continuously working press of this kind.

OBJECT OF THE INVENTION

The object of the invention is to design a continuously operating press of the initially named kind with simple technical means so that a problem-free edge width adjustment can be effected which ensures the ability to maintain the tolerances of the respective pressed web.

BRIEF DESCRIPTION OF THE INVENTION

In accordance with the invention, this object is satisfied in accordance with a first embodiment of the double-belt press of the invention substantially in that the slide lining includes a central main zone and at least one pair of marginal strip regions disposed symmetrically about the center of the slide lining, wherein transition regions, which are free of grooves, or provided with blind grooves serving neither as a supply nor as a discharge for lubricant, are provided between the main zone and the marginal strip zones and optionally between adjacent marginal strip zones .

The object is alternatively also achieved in that the slide lining includes a central main zone and at least one pair of marginal strip zones disposed symmetrically about the center of the slide lining, with the main zone and the marginal strip zones, and optionally the plural pairs of marginal strip zones, directly bordering on one another, and in that adjacent grooves to one another in the main zone and in the marginal strip zones are alternately provided with supply and discharge openings for the lubricant.

This embodiment of the double belt press is particularly advantageous in the manufacture and/or coating of a web with relatively small total finished thickness.

Through these measures one succeeds, in a surprisingly simple manner, in producing boards of different widths in the same continuously operating press with high quality and high maintenance of tolerances in the marginal zones, or in coating such boards, because precisely defined pressure conditions prevail in the marginal zones of the respectively used press zone and no disturbing pressure differences can become established towards the respective marginal zones.

In the case of the double belt press in accordance with the invention, in which the slide lining also has transition zones, the number of centrally symmetrical pairs of marginal strip zones, the width of the marginal strip zones and also the width of the transition zones are respectively selected, in accordance with predetermined board widths, so that marginal strip zones which are not associated with the momentarily activated press area zone can be deactivated; i.e. the lubricant circuits, which are associated which these marginal strip zones, can be either fully switched off or can be strongly reduced with respect to the pressure generated.

In the case of the alternative embodiment of the double belt press of the invention in which the slide lining has a main zone and marginal strip zones but no transition zones, the number or the width of the marginal strip zones is selected in accordance with the maximum possible pressed web width. In this case the width of the web to be pressed can be advantageously, steplessly selected between a minimum and a maximum, which are each preset by the number and the width of the marginal strip zones. It is not necessary, for different widths of the respective web to be pressed, to provide partial lubricant circuits which have to be differentially controlled with respect to the pressure or the temperature of the lubricant supplied in the different marginal strip zones. The lubricant can be supplied in a circuit—in each case under constant predeterminable pressure and predeterminable temperature.

Particularly advantageous designs of the invention and expedient possible designs for the grooves used in the slide linings are set forth in the subordinate claims.

BRIEF LISTING OF THE FIGURES

FIG. 1 is a schematic, partly broken away illustrated cross-section through the lower part of a continuously operating press in accordance with the first embodiment of the invention, FIG. 2 is a schematic representation of a plan view of a section of a slide lining zone of the press of FIG. 1, and FIGS. 3 is and 4 is schematic cross-sections shown partly broken away through the lower part and the upper part of the continuously operating press in accordance with the alternative embodiment of the invention.

DESCRIPTION OF PREFERRED EMBODIMENTS

Figure 1:
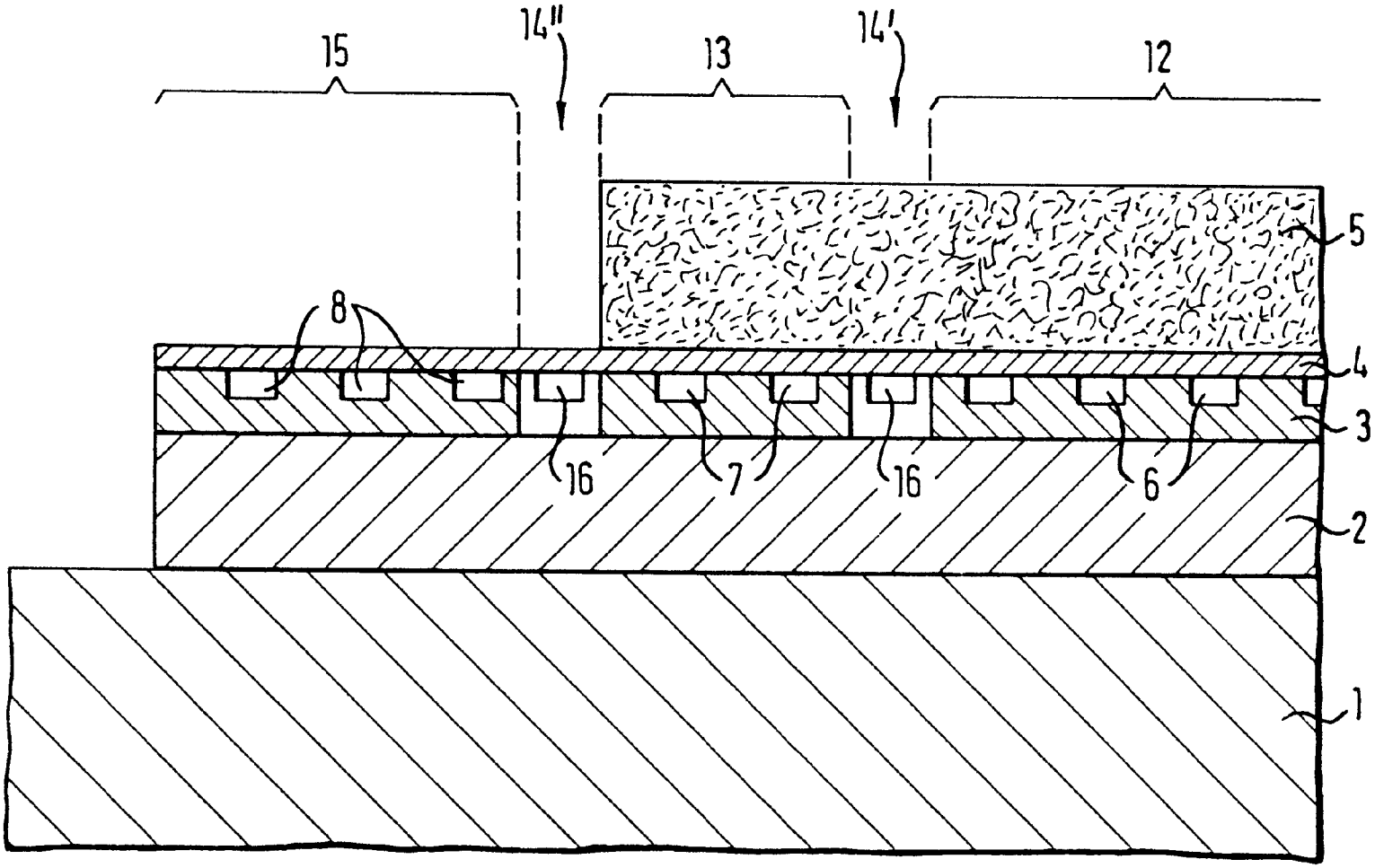

FIG. 1 shows, in accordance with the first embodiment of the invention, a lower press plate 1, a support 2 arranged thereon and also a slide lining 3 supported on this support 2 for an endless press band 4. A board 5 built up from a mat or fleece is located in the press gap formed between two oppositely disposed press belts 4. In the illustrated embodiment this board 5 has the maximum possible width for the relevant press shown in the illustrated example.

Grooves 6 are formed in the main press zone 12 of the slide lining 3. A marginal strip zone 13 has grooves 7 and an outer marginal zone 15 is provided with grooves 8. A lubricant is supplied at a predeterminable pressure and predeterminable temperature to the main zone grooves 6 and to the grooves 7 formed in the marginal strip zone 13. The lubricant is also led away again via these grooves. The supply and discharge preferably takes place via adjacent grooves.

The lubricant which is supplied and discharged via the grooves 6, 7 forms a supporting slide film for the endless press belt 4, which normally consists of a steel band.

The grooves 8 provided in the outer marginal zone 15 of the slide lining 3 serves for the swirling, for the pressure dissipation and for the capturing of the lubricant which escapes sideways from the press zone 12, 13. This captured lubricant is returned back into the lubricant circuit, optionally after renewed heating.

Between both the main zone 12 and the marginal strip zone 13, and also between the latter and the outer marginal zone 15, there is in each case provided a transition zone 14' or 14" respectively, which is provided with blind grooves 16. Neither supply nor a discharge of lubricant takes place via the blind grooves 16. The blind grooves 16 thus merely represent cutouts in the slide lining 3, the depth of which is preferably the same as that of the groove 6, 8 in the main zone 12 and/or in the outer marginal zone 15.

The arrangement and the support of the press belt arranged on the other side of the board 5 takes place in analogous manner to that which is shown in FIG. 1 for the lower part.

Figure 2:
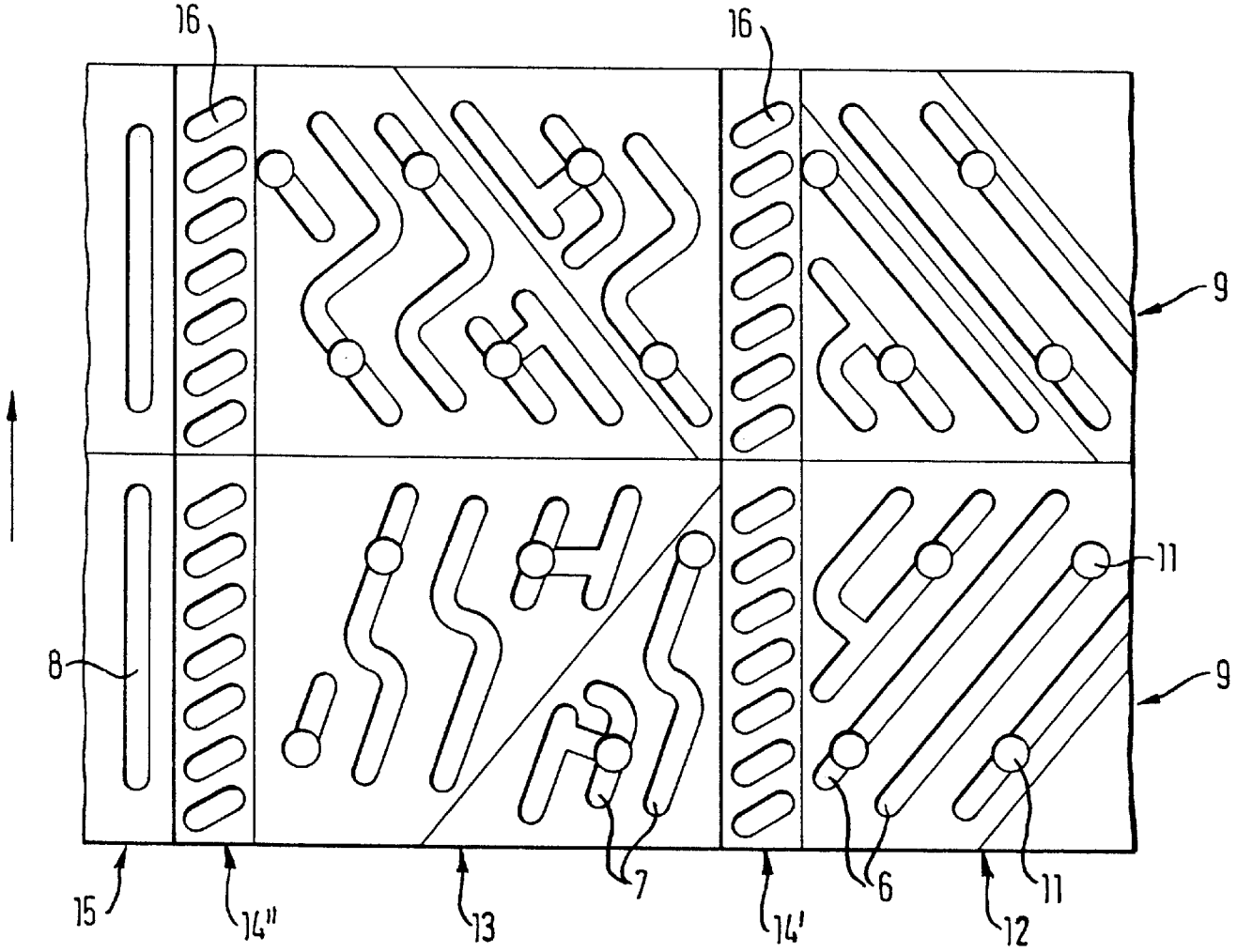

The plan view of FIG. 2 shows a section of the slide lining 3, with the grooves 6, 7, 8, 16 formed therein, and also with the supply and discharge openings 11 for the lubricant.

The slide lining 3 consists of a plurality of slide lining sections 9 which are arranged bordering on each other, which abut one another in the running direction of the press belt characterized by the arrow. These slide lining sections 9 can also be subdivided transverse to the running direction of the press belt.

The main zone 12 extends up to a first transition zone 14', which is adjoined by the marginal strip zone 13. The outer boundary of a second transition zone 14", which in turn adjoins the marginal strip zone 14, characterizes the maximum pressing area width. The outer marginal zone 15, in which the grooves 8 extend approximately in the running direction of the press belt for the swirling and collecting of lubricant which emerges sideways, adjoins the second transition zone 14". Possible designs of this marginal zone are described in the European patent application EP 0 491 972.

A plurality of marginal strip zones disposed alongside one another, and also a correspondingly larger number of transition zones, can also be provided.

The blind grooves 16 formed in the transition zones 14' and 14" are respectively formed as short straight recesses in the slide lining 3, which represent neither a supply nor a discharge for the lubricant. The blind grooves 16 can fundamentally have any desired shape and can also be differently directed from the embodiment of FIG. 2.

Grooves 6, 7 for the supply and discharge of the lubricant are provided in the slide lining 3 associated with the press zone 12, 13 in the already mentioned manner. In order to ensure a problem-free adjustment of the marginal width which ensures that the tolerances are maintained, provision is made that neither the grooves 6 of the main zone 12 nor the grooves 7 of the marginal strip zone 13 extend into the transition zones 14', 14". In just the same way the blind grooves 16 lie exclusively within their respective transition zone 14', 14'.

In this manner it is possible to load the press belt, i.e. to set it under pressure and to keep it at a particular temperature, in each case in accordance with the selected press zone extending up to the first transition zone 14' or up to the second transition zone 14".

If, for example, the press is operated in such a manner that the total pressing procedure takes place in the main zone 12, and accordingly the marginal strip zones 13 do not participate in the pressing procedure, then the separate lubricant circuit associated with the marginal strip zones 13 can be switched off fully, or substantially reduced in pressure, with it also being possible to ensure that the press belt retains the same temperature over its full width, and thus that no problems arise in the regions of the deflection rolls.

If a mat having a width which corresponds to the maximum press zone width, which is determined by the outer boundary of the second transition zone 14", is supplied to the continuously operating press, then the lubricant circuits for the main zone 12 and for the marginal strip zones 13, which can naturally also be controlled separately in principle, are operated in the same manner.

The grooves formed in the slide linings which are preferably assembled from sector elements, including the blind grooves in the transition zones, can have different shape, size and inclination with respect to the running direction of the press belt.

FIG. 2 shows examples of such groove designs, with these examples, however, not being restrictive.

At least some of the grooves 6, 7 provided in the main zone 12 and in the marginal strip zones 13 are preferably L-shaped or Z-shaped and at least some of the grooves can also consist of a straight elongate section and an L-shaped section, with the short part of the L-shaped section opening substantially perpendicularly into the elongate section. The inclined position of the grooves 6 in the main zone 12 with respect to the running direction of the press belt is preferably more pronounced than the inclined position of the groove 7 in the marginal strip zones 13. The angle of inclination expediently lies in the range from about 10 to 45°, with substantial freedom being given design-wise.

The same shapes can be selected for the blind grooves 16 as are selected for the grooves 6, 7 in the main zone 12 or in the marginal strip zone 13 respectively.

Figure 3:
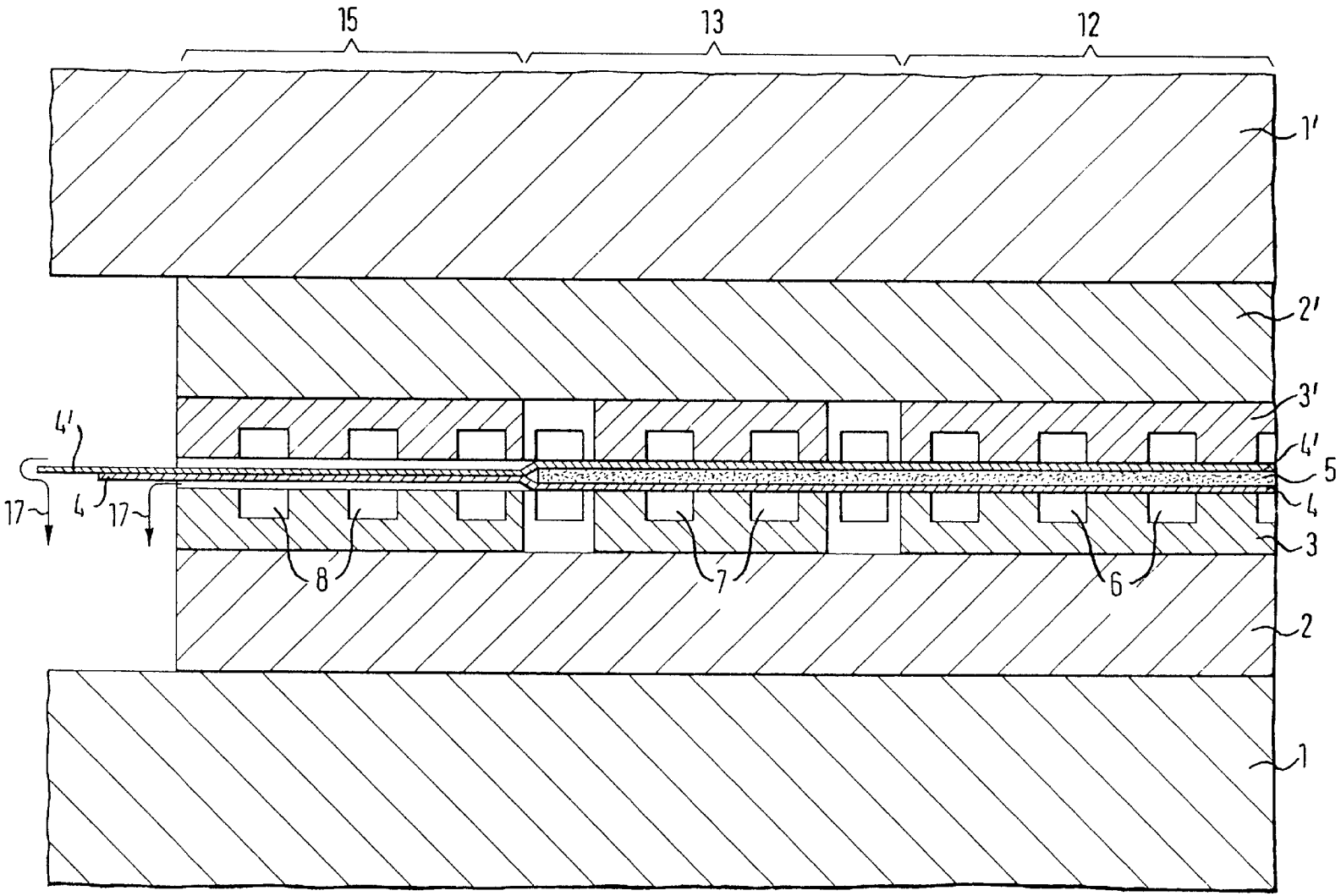
Figure 4:
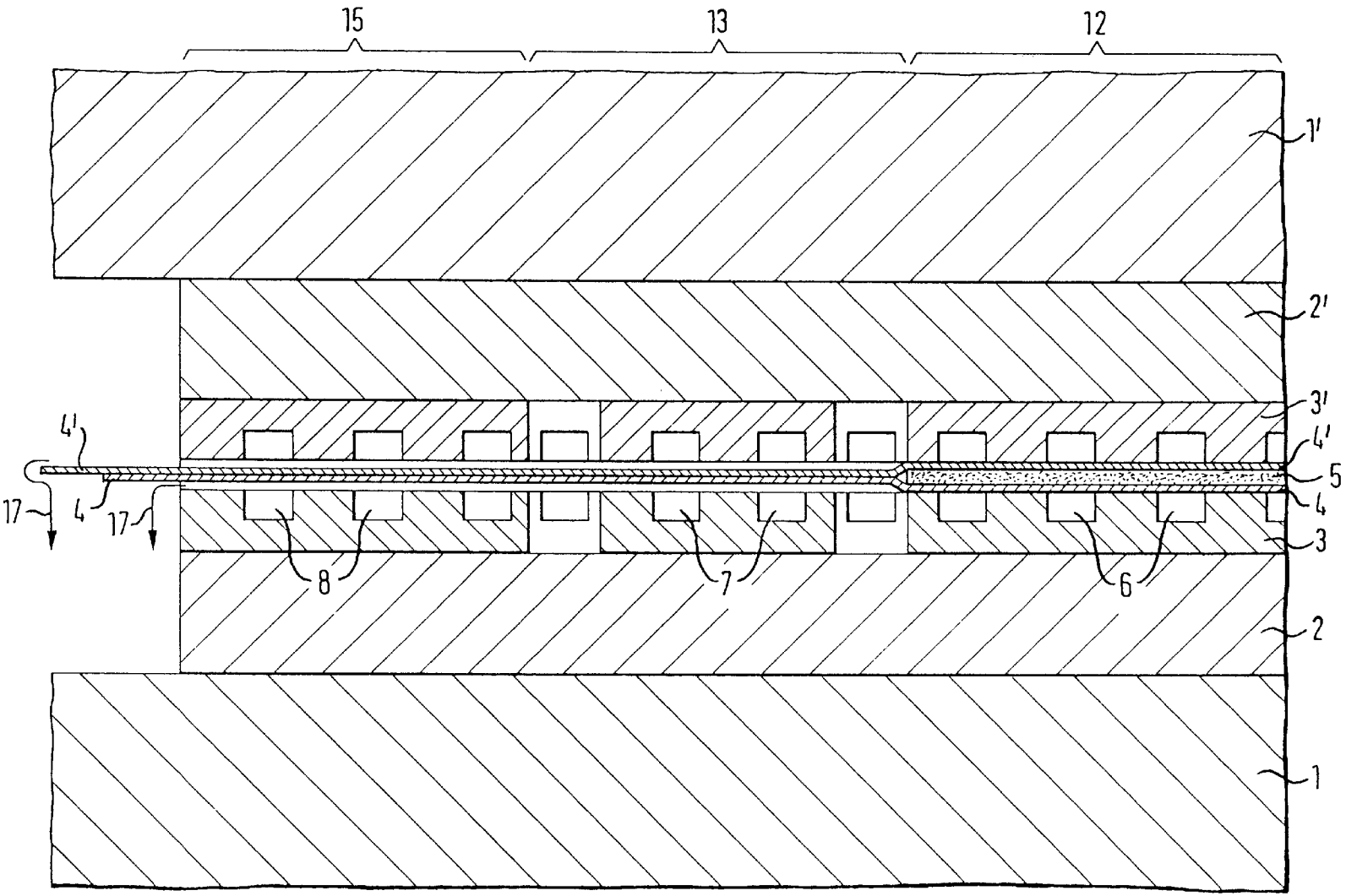

FIGS. 3 and 4 show in schematic side-view a section of a continuously operating double belt press in accordance with an alternative embodiment of the invention.

This double belt press has a lower press plate and an upper press plate 1, 1' respectively, which are arranged parallel to one another and spaced apart in the vertical direction. At the sides of the press boards 1, 1', which respectively face towards the center of this arrangement, there is located a lower and an upper support 2 and 2" respectively, which are respectively contacted by a lower and an upper slide lining 3, 3' respectively. A lower and an upper press belt 4 and 4' respectively are present between the two oppositely disposed slide linings 3, 3' respectively. A plate or web 5 to be pressed is located between the upper and lower press belts 4, 4' within a predetermined width zone of the double belt press.

The slide lining 3, 3' is subdivided in symmetrical manner along planes which lie parallel to the vertical direction and perpendicular to the plane of the drawing of FIGS. 3 and 4 into a main zone 12, a pair of marginal strip zones 13, which directly border on the main zone 12 in each case, and a pair of outer marginal zones 15, which respectively directly adjoin one marginal strip zone 13. In the illustration of FIGS. 3 and 4, only one marginal strip zone 13 and one outer marginal zone 15 is shown in each case. The slide linings 3, 3' have grooves 6 in the main zone 12 at their sides respectively facing the press belts 4, 4' and grooves 7 in the marginal strip zone 13 which each have a supply or discharge opening which are not shown in FIGS. 3 and 4. In the outer marginal zone 15 the slide linings 3, 3' have grooves 8, which preferably each have a non-illustrated discharge opening.

The double belt press shown in FIGS. 3 and 4 thus has a similar basic construction to that of the double belt press shown in FIG. 1. In contrast to that first embodiment of the invention, it has no transition zones 14', 14" between the main zone 12 and the marginal strip zones 13 or between the marginal strip zones 13 and the outer marginal zones 15.

The double belt press of the invention in accordance with FIGS. 3 and 4 is designed for the continuous manufacture or coating of single or multi-ply webs 5. For this purpose the web 5 is transported by the press belts 4, 4' formed as endless steel bands in a direction perpendicular to the plane of the paper and compressed. During this, lubricant is supplied with a predeterminable pressure and predeterminable temperature to, and moved away again from, the respective gap between the slide lining 3, 3' and the press belt 4 and 4' respectively, through openings in the grooves 6 of the main zone 12 and in the grooves 7 of the marginal strip zones 13. In accordance with the invention, lubricant is alternatively supplied to adjacent grooves 6, 7 in the main zone 12 and in the adjacent marginal strip zones 13 and is removed again via grooves.

The press belts 4, 4' thus move on a sliding film, which is formed by the lubricant and which supports the press belts 4, 4' on the slide linings 3, 3'. The grooves 8 provided in the outer marginal zone 15 of the slide linings 3, 3' serve for the swirling, for the pressure dissipation and for the capture of the lubricant which escapes sideways out of the marginal strip zones 13. The lubricant 17, which escapes and flows away at the outer margin of the outer marginal zone 15 from the respective gap between the slide lining 3, 3' and the press belt 4, 4' respectively, is captured by a suitable device. The lubricant captured in the outer marginal zones 15 or at their edges is returned to the lubricant circuit again, optionally after renewed heating.

As the double belt press shown in FIGS. 3 and 4 does not require any transition zones 1 4', 14", in contrast to the embodiment of the invention shown in FIG. 1, the width of the web 5 to be pressed can be steplessly varied in advantageous manner between a minimum and a maximum. In this respect the minimum is given by the width of the main zone 12 and the maximum by the width of the pairs of marginal strip zones 13. FIG. 3 shows the pressing of a web 5, which has the maximum possible width within the illustrated double belt press. In FIG. 4 the pressing of a web of minimum width is shown.

For different widths of the web 5 to be pressed it is not necessary to activate or switch off different partial lubricant circuits or to strongly reduce them with respect to the pressure generated. It is thus in particular possible to provide a single circuit for the supply and discharge of the lubricant through the grooves 6, 7 within a section of the main zone 12 and of the marginal strip zones 13 bounded in the running direction of the press belt.

In the zones in which the two press belts 4, 4' do not act on the web 5, i.e. at least in the two outer marginal zones 15, the two press belts 4, 4' lie substantially directly against one another. Thus, the double belt press shown in FIGS. 3 and 4 is particularly suitable for the manufacture or coating of a one or multiple-ply web of particular starting material, such as a one or multi-ply resin impregnated paper-web, glass fabric web or glass fiber mat, which in each case have a relatively low total finished thickness. The double belt press operates particularly well with a total finished thickness of between 0.7 and 1.5 mm.

The design of the grooves 6, 7, 8 shown in FIGS. 3 and 4 can take place in the same manner as shown in FIG. 2 and as explained in connection with FIGS. 1 and 2. The slide lining 3, 3' can also consist of a plurality of slide lining sections which border on one another and which are subdivided in and/or transverse to the running direction of the press belt, as already described in connection with FIG. 2.

REFERENCE NUMERAL LIST

1 lower press plate
1' upper press plate
2 lower support
2' upper support
3 lower slide lining
3' upper slide lining
4 lower press belt
4' upper press belt
5 board or pressed web
6 grooves in the main zone
7 grooves in the marginal strip zone
8 grooves in the outer marginal zone
9 sections of the slide lining
11 supply discharge openings
12 main zone
13 marginal strip zone
14', 14" transition zone
15 outer marginal zone
16 blind grooves
17 flowing away lubricant

What is claimed is:

1. Continuously operating double-belt press, in particular for the manufacture and/or coating of a one-ply or multiple-ply web of particulate starting material, which runs in the transport direction between the upper run of a lower, endless press belt and the lower run of an upper, endless press belt circulating with predetermined speed, wherein a respective slide lining having grooves, which extends over the full width of the press zone, is mounted on each of an upper and a lower support and is put together from individual sections, wherein the press belt associated with each slide lining slides over it by means of a liquid lubricant which is supplied under pressure, which is supplied via supply lines and through supply openings to form a sliding layer, and which is led off through discharge openings and through discharge lines connected thereto and is supplied to the press again in a circuit, characterized in that each slide lining includes a central main zone and at least one pair of marginal strip regions disposed symmetrically about the center of the slide lining, wherein transition regions, which are free of grooves, or provided with blind grooves serving neither as a supply nor as a discharge for lubricant, are provided between the main zone and the marginal strip zones.

2. Press in accordance with claim 1, characterized in that the number and/or the width of the pairs of marginal strip zones and/or the width of the transition regions is selected in accordance with predetermined board widths.

3. Press in accordance with claim 1, characterized in that the outermost marginal strip zones are respectively followed first by a further transition zone and then by an outer marginal zone.

4. Press in accordance with claim 3, characterized in that the outer marginal zone is provided with grooves which extend approximately in the running direction of the press belt for the swirling and collecting of lubricant which has emerged sideways.

5. Press in accordance with claim 1, characterized in that adjacent grooves in the main zone and in the marginal strip zones are alternately provided with supply and discharge openings for the lubricant.

6. Press in accordance with claim 1, characterized in that the grooves in the marginal strip zones can be used as pressure dissipation grooves and lubricant capture grooves for boards, the width of which lies between the main zone width and the total width of the main zone and the adjacent transition zones on both sides.

7. Press in accordance with claim 6, characterized in that the blind grooves in the transition zones are aligned in the same direction or differently.

8. Press in accordance with claim 1, wherein each slide lining extends over and sideways beyond the full width of the press zone.

9. Press in accordance with claim 1, wherein the press belt associated with each slide lining slides over it by means of a liquid lubricant which is heated or cooled.

10. Press in accordance with claim 1, wherein transition zones, which are free of grooves, or provided with blind grooves serving neither as a supply nor as a discharge for lubricant, are provided between adjacent marginal strip zones.

11. Continuously operating double-belt press, in particular for the manufacture and/or coating of a one-ply or multiple-ply web of particulate starting material, which runs in the transport direction between the upper run of a lower endless press belt and the lower run of an upper, endless press belt circulating with predetermined speed, wherein a respective slide lining having grooves, which extends over the full width of the press zone, is mounted on each of an upper and a lower support and is put together from individual sections, wherein the press belt associated with each slide lining slides over it by means of a liquid lubricant which is supplied under pressure, which is supplied via supply lines and through supply openings to form a sliding layer, and which is led off through discharge openings and through discharge lines connected thereto and is supplied to the press again in a circuit, characterized in that each slide lining includes a central main zone and at least one pair of marginal strip zones disposed symmetrically about the center of the slide lining, with the main zone and the marginal strip zones directly bordering on one another, and wherein adjacent grooves to one another in the main zone and in the marginal strip zones are alternatively provided with supply and discharge openings for the lubricant.

12. Press in accordance with claim 11, characterized in that grooves adjacent to one another in marginal strip zones which border on one another are alternately provided with supply and discharge openings for the lubricant.

13. Press in accordance with claim 12, characterized in that the lubricant can be respectively guided in a circuit, in each case at constant, predeterminable pressure and predeterminable temperature.

14. Press in accordance with claim 11, characterized in that the number and/or the width of pairs of marginal strip zones is selected in accordance with the maximum possible press web width.

15. Press in accordance with claim 11, characterized in that the width of the web to be pressed can be steplessly selected between a minimum and a maximum, which is in each case predetermined by the number and the width of pairs of marginal strip zones.

16. Press in accordance with claim 11, characterized in that a respective outer marginal zone adjoins the outermost marginal strip zones, with the marginal outer zone being provided with grooves which extend approximately in the running direction of the press belt for the swirling and collecting of lubricant which emerges sideways.

17. Press in accordance with claim 1, characterized in that the elongate grooves in the main zone and in the marginal strip zones are at least partly obliquely arranged with respect to the running direction of the press belt, with the oblique position of the grooves in the marginal strip zones of the slide lining being smaller than in the main zone.

18. Press in accordance with claim 11, characterized in that at least some of the grooves are L-shaped or are at least substantially Z-shaped, with the individual sections of the grooves extending in particular perpendicular to one another or consisting of a straight, elongate section and an L-shaped section, with the short partial zone of the L-shaped section opening substantially perpendicularly into the elongate section.

19. Press in accordance with claim 11, characterized in that the elongate grooves in the main zone and in the marginal strip zones are at least partly obliquely arranged with respect to the running directions of the press belt, with the oblique position of the grooves in the marginal strip zones of the slide lining being smaller than in the main zone.

20. Press in accordance with claim 11, characterized in that at least some of the grooves are L-shaped or are at least substantially Z-shaped, with the individual sections of the grooves extending perpendicular to one another or consisting of a straight, elongate section and an L-shaped section, with the short partial zone of the L-shaped section opening substantially perpendicularly into the elongate section.

21. Use of a press in accordance with claim 11, for the manufacture and/or coating of a one-ply or a multiple-ply web of particulate starting material, or of a one-ply or a multiple-ply and resin-impregnated paper-web, glass fabric web or glass fiber mat, wherein each of the said webs or the glass fiber mat has a copper foil laminated onto it.

22. Press in accordance with claim 11, wherein each slide lining extends over and sideways beyond the full width of the press zone.

23. Press in accordance with claim 11, wherein the press belt associated with each slide lining slides over it by means of a liquid lubricant which is heated or cooled.

* * * * *